US012274296B2

(12) United States Patent
Woodman et al.

(10) Patent No.: US 12,274,296 B2
(45) Date of Patent: Apr. 15, 2025

(54) COMPONENT FOR A NON-COMBUSTIBLE AEROSOL PROVISION SYSTEM

(71) Applicant: Nicoventures Trading Limited, London (GB)

(72) Inventors: Tom Woodman, London (GB); Walid Abi Aoun, London (GB)

(73) Assignee: NICOVENTURES TRADING LIMITED, London (GB)

( * ) Notice: Subject to any disclaimer, the term of this patent is extended or adjusted under 35 U.S.C. 154(b) by 381 days.

(21) Appl. No.: 17/756,498

(22) PCT Filed: Nov. 27, 2020

(86) PCT No.: PCT/GB2020/053064
§ 371 (c)(1),
(2) Date: May 26, 2022

(87) PCT Pub. No.: WO2021/105722
PCT Pub. Date: Jun. 3, 2021

(65) Prior Publication Data

US 2023/0000155 A1 Jan. 5, 2023

(30) Foreign Application Priority Data

Nov. 29, 2019 (GB) ..... 1917516

(51) Int. Cl.
*A24F 40/42* (2020.01)
*A24F 40/20* (2020.01)
*A24F 40/48* (2020.01)

(52) U.S. Cl.
CPC ..... *A24F 40/42* (2020.01); *A24F 40/20* (2020.01); *A24F 40/48* (2020.01)

(58) Field of Classification Search
CPC ..... A24F 40/42
See application file for complete search history.

(56) References Cited

U.S. PATENT DOCUMENTS

| | | | |
|---|---|---|---|
| 3,200,819 | A | 8/1965 | Gilbert |
| 2017/0027225 | A1 | 2/2017 | Buchberger et al. |
| 2017/0119050 | A1 | 5/2017 | Blandino et al. |

(Continued)

FOREIGN PATENT DOCUMENTS

| | | | |
|---|---|---|---|
| CN | 87105964 | A | 6/1988 |
| JP | 2017506502 | A | 3/2017 |

(Continued)

OTHER PUBLICATIONS

International Search Report and Written Opinion for Application No. PCT/GB2020/053064, mailed on Mar. 9, 2021, 16 pages.

(Continued)

*Primary Examiner* — Cynthia Szewczyk
(74) *Attorney, Agent, or Firm* — Husch Blackwell

(57) ABSTRACT

A component for a non-combustible aerosol provision system. The component comprises a body defining an enclosed volume, the body comprising an inlet aperture and an outlet aperture, and an air flow path defined between the inlet aperture and the outlet aperture through the enclosed volume. The body includes a support element comprising an arrangement of alternating ridges and grooves. Also disclosed is a system comprising such a component.

19 Claims, 15 Drawing Sheets

(56) References Cited

U.S. PATENT DOCUMENTS

| | | | | |
|---|---|---|---|---|
| 2017/0143041 | A1* | 5/2017 | Batista | A24F 1/00 |
| 2020/0221767 | A1* | 7/2020 | Emmett | A24B 3/14 |
| 2021/0289840 | A1* | 9/2021 | Taurino | A61M 11/042 |

FOREIGN PATENT DOCUMENTS

| | | | |
|---|---|---|---|
| JP | 2017522873 | A | 8/2017 |
| KR | 20170020807 | A | 2/2017 |
| RU | 61096 | U1 | 2/2007 |
| WO | WO-2015082651 | A1 | 6/2015 |
| WO | 2015114328 | A1 | 8/2015 |
| WO | WO-2016005533 | A1 | 1/2016 |
| WO | WO-2016005600 | A1 | 1/2016 |
| WO | WO-2017202965 | A1 | 11/2017 |
| WO | 2019106040 | A1 | 6/2019 |
| WO | WO-2019162497 | A1 | 8/2019 |
| WO | WO-2020020916 | A1 | 1/2020 |
| WO | WO-2020020917 | A1 | 1/2020 |

OTHER PUBLICATIONS

Search Report under Section 17(5) for Great Britain Application No. 1917516.5, mailed on May 4, 2020, 4 pages.

"International Preliminary Report on Patentability received for PCT Patent Application No. PCT/GB2020/053064, mailed on Jun. 9, 2022", 8 Pages.

"Office Action received for Korean Patent Application No. 10-2022-7017675, mailed on Jun. 13, 2024", 14 pages (7 Pages of English Translation and 7 Pages of Official Copy).

"Office Action received for Russian Patent Application No. 2022114123, mailed on Feb. 27, 2024", 12 pages (4 Pages of English Translation and 8 pages of Official Copy).

* cited by examiner

COMPONENT FOR A NON-COMBUSTIBLE AEROSOL PROVISION SYSTEM

PRIORITY CLAIM

The present application is a National Phase entry of PCT Application No. PCT/GB2020/053064, filed Nov. 27, 2020, which claims priority from Great Britain Application No. 1917516.5, filed Nov. 29, 2019, each of which is hereby fully incorporated herein by reference.

TECHNICAL FIELD

The present disclosure relates to a component for a non-combustible aerosol provision system and a non-combustible aerosol provision system including a component.

BACKGROUND

Smoking articles such as cigarettes, cigars and the like burn tobacco during use to create tobacco smoke. Alternative smoking articles produce an inhalable aerosol or vapor by releasing compounds from a substrate material without burning. These articles may be referred to as non-combustible smoking articles or aerosol provision systems. Such articles commonly include a mouthpiece through which the aerosol passes to reach the users mouth.

SUMMARY

A first aspect of the disclosure provides a component for a non-combustible aerosol provision system, the component comprising a body defining an enclosed volume, the body comprising an inlet aperture and an outlet aperture, and an air flow path defined between the inlet aperture and the outlet aperture through the enclosed volume; and wherein the body includes a support element comprising an arrangement of alternating ridges and grooves.

A second aspect of the disclosure provides a non-combustible aerosol provision system comprising a component according to the first aspect of the disclosure, wherein the component is an article, and an aerosol generating material is provided within the enclosed volume, and a non-combustible aerosol provision device for heating the aerosol-generating material of the article.

A third aspect of the disclosure provides a system comprising a non-combustible aerosol provision device comprising a component according to the first aspect of the disclosure, and an article comprising an aerosol-generating material.

BRIEF DESCRIPTION OF THE DRAWINGS

Embodiments of the disclosure will be described with reference to the accompanying drawings, in which.

DETAILED DESCRIPTION OF THE DRAWINGS

Figure 1:
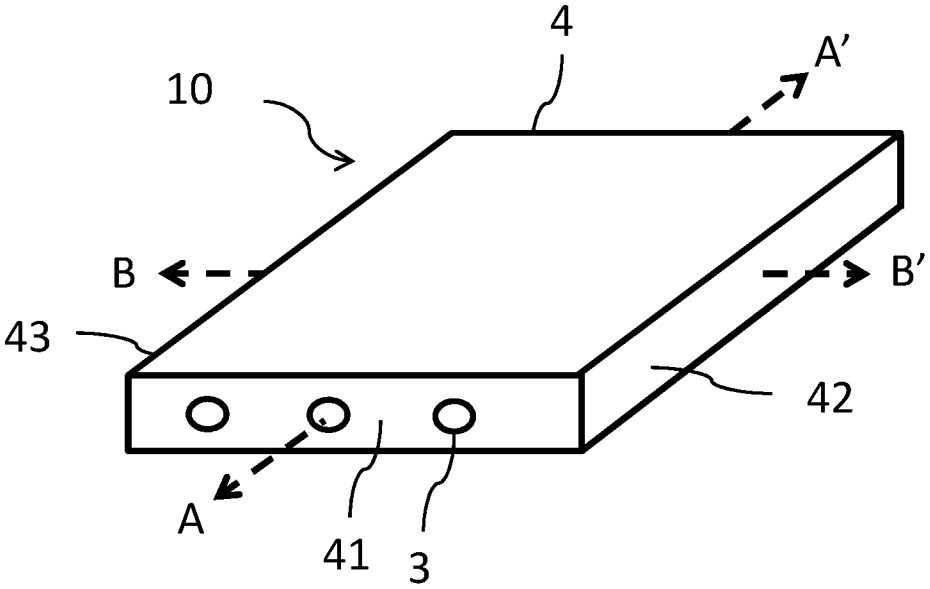
FIG. 1 is a perspective illustration of a component (e.g., an article) for use with a non-combustible aerosol provision device, the article including an inlet aperture and an outlet aperture.

As used herein, the term "delivery system" is intended to encompass systems that deliver at least one substance to a user, and includes:

- combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokable material);
- non-combustible aerosol provision systems that release compounds from an aerosol-generating material without combusting the aerosol-generating material, such as electronic cigarettes, tobacco heating products, and hybrid systems to generate aerosol using a combination of aerosol-generating materials; and aerosol-free delivery systems that deliver the at least one substance to a user orally, nasally, transdermally or in another way without forming an aerosol, including but not limited to, lozenges, gums, patches, articles comprising inhalable powders, and oral products such as oral tobacco which includes snus or moist snuff, wherein the at least one substance may or may not comprise nicotine.

According to the present disclosure, a "combustible" aerosol provision system is one where a constituent aerosol-generating material of the aerosol provision system (or component thereof) is combusted or burned during use in order to facilitate delivery of at least one substance to a user.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

In some embodiments, the consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

In some embodiments, the substance to be delivered may be an aerosol-generating material or a material that is not intended to be aerosolized. As appropriate, either material may comprise one or more active constituents, one or more flavors, one or more aerosol-former materials, and/or one or more other functional materials.

In some embodiments, the substance to be delivered comprises an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, *cannabis* or another botanical.

In some embodiments, the active substance comprises nicotine. In some embodiments, the active substance comprises caffeine, melatonin or vitamin B12.

As noted herein, the active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, *eucalyptus*, star anise, hemp, cocoa, *cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, *papaya*, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *curcuma*, turmeric, sandalwood, cilantro, bergamot, orange blossom, myrtle, cassis, valerian, pimento, mace, damien, marjoram, olive, lemon balm, lemon basil, chive, *carvi, verbena*, tarragon, geranium, mulberry, *ginseng*, theanine, theacrine, maca, ashwagandha, damiana, guarana, chlorophyll, baobab or any combination thereof. The mint may be chosen from the following mint varieties: *Mentha* Arventis, *Mentha* c.v., *Mentha niliaca, Mentha piperita, Mentha piperita citrata* c.v., *Mentha piperita* c.v, *Mentha spicata crispa, Mentha* cardifolia, Memtha *longifolia, Mentha suaveolens variegata, Mentha pulegium, Mentha spicata* c.v. and *Mentha suaveolens*

In some embodiments, the active substance comprises or is derived from one or more botanicals or constituents, derivatives or extracts thereof and the botanical is tobacco.

In some embodiments, the active substance comprises or is derived from one or more botanicals or constituents, derivatives or extracts thereof and the botanical is selected from *eucalyptus*, star anise, cocoa and hemp.

In some embodiments, the active substance comprises or is derived from one or more botanicals or constituents, derivatives or extracts thereof and the botanical is selected from rooibos and fennel.

In some embodiments, the substance to be delivered comprises a flavor.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, *cannabis*, licorice (liquorice), *hydrangea*, eugenol, Japanese white bark *magnolia* leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, *papaya*, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, *betel*, shisha, pine, honey essence, rose oil, vanilla, lemon oil, orange oil, orange blossom, cherry blossom, *cassia*, caraway, cognac, jasmine, ylang-ylang, sage, fennel, wasabi, piment, ginger, coriander, coffee, hemp, a mint oil from any species of the genus *Mentha, eucalyptus*, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, *curcuma*, cilantro, myrtle, cassis, valerian, pimento, mace, damien, marjoram, olive, lemon balm, lemon basil, chive, *carvi, verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from *cannabis*.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Aerosol-generating material is a material that is capable of generating aerosol, for example when heated, irradiated or energized in any other way. Aerosol-generating material may, for example, be in the form of a solid, liquid or gel which may or may not contain an active substance and/or flavorants. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid.

Aerosol-generating material may also be referred to herein as aerosolizable material.

The aerosol-generating material may comprise one or more active substances and/or flavors, one or more aerosol-former materials, and optionally one or more other functional material.

The aerosol-former material may comprise one or more constituents capable of forming an aerosol. In some embodiments, the aerosol-former material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

In other embodiments, the aerosol former comprises one or more polyhydric alcohols, such as 1,3-butanediol; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

The one or more other functional materials may comprise one or more of pH regulators, coloring agents, preservatives, binders, fillers, stabilizers, and/or antioxidants.

The material may be present on or in a carrier, to form a substrate. The carrier may, for example, be or comprise paper, card, paperboard, cardboard, reconstituted material, a plastics material, a ceramic material, a composite material, glass, a metal, or a metal alloy. In some embodiments, the carrier comprises a susceptor. In some embodiments, the susceptor is embedded within the material. In some alternative embodiments, the susceptor is on one or either side of the material.

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

As used herein, the term "aerosolizable material" includes materials that provide volatilized components upon heating, typically in the form of vapor or an aerosol. "Aerosolizable material" may be a non-tobacco-containing material or a tobacco containing material. "Aerosolizable material" may, for example, include one or more of tobacco per se, tobacco derivatives, expanded tobacco, reconstituted tobacco, tobacco extract, homogenized tobacco or tobacco substitutes. The aerosolizable material can be in the form of ground tobacco, cut rag tobacco, extruded tobacco, reconstituted tobacco, reconstituted aerosolizable material, liquid, gel, a solid, an amorphous solid, gelled sheet, powder, beads, granules, or agglomerates, or the like. "Aerosolizable material" also may include other, non-tobacco, products, which, depending on the product, may or may not contain nicotine. "Aerosolizable material" may comprise one or more humectants, such as glycerol or propylene glycol.

In some cases, the amorphous solid may have a thickness of about 0.015 mm to about 1.0 mm. Suitably, the thickness may be in the range of about 0.05 mm, 0.1 mm or 0.15 mm to about 0.5 mm or 0.3 mm. The inventors have found that a material having a thickness of 0.2 mm is suitable. The amorphous solid may comprise more than one layer, and the thickness described herein refers to the aggregate thickness of those layers.

The thickness stipulated herein is a mean thickness for the material. In some cases, the amorphous solid thickness may vary by no more than 25%, 20%, 15%, 10%, 5% or 1%.

In some cases, the amorphous solid may comprise 1-60 wt % of a gelling agent wherein these weights are calculated on a dry weight basis.

Suitably, the amorphous solid may comprise from about 1 wt %, 5 wt %, 10 wt %, 15 wt %, 20 wt % or 25 wt % to about 60 wt %, 50 wt %, 45 wt %, 40 wt %, 35 wt %, 30 wt % or 27 wt % of a gelling agent (all calculated on a dry weight basis). For example, the amorphous solid may comprise 1-50 wt %, 5-40 wt %, 10-30 wt % or 15-27 wt % of a gelling agent.

The gelling agent may comprise one or more compounds selected from cellulosic gelling agents, non-cellulosic gelling agents, guar gum, acacia gum and mixtures thereof.

In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof.

In some embodiments, the gelling agent comprises (or is) one or more of hydroxyethyl cellulose, hydroxypropyl cellulose, hydroxypropyl methylcellulose (HPMC), carboxymethylcellulose, guar gum, or acacia gum.

In some embodiments, the gelling agent comprises (or is) one or more non-cellulosic gelling agents, including, but not limited to, agar, xanthan gum, gum Arabic, guar gum, locust bean gum, pectin, carrageenan, starch, alginate, and combinations thereof. In some embodiments, the non-cellulose based gelling agent is alginate or agar.

In some embodiments, the gelling agent comprises a hydrocolloid. In some embodiments, the gelling agent comprises one or more compounds selected from the group comprising alginates, pectins, starches (and derivatives), celluloses (and derivatives), gums, silica or silicones compounds, clays, polyvinyl alcohol and combinations thereof. For example, in some embodiments, the gelling agent comprises one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent comprises alginate and/or pectin, and may be combined with a setting agent (such as a calcium source) during formation of the amorphous solid. In some cases, the amorphous solid may comprise a calcium-crosslinked alginate and/or a calcium-crosslinked pectin.

In some embodiments, the gelling agent comprises alginate, and the alginate is present in the amorphous solid in an amount of from 10-30 wt % of the amorphous solid (calculated on a dry weight basis). In some embodiments, alginate is the only gelling agent present in the amorphous solid. In other embodiments, the gelling agent comprises alginate and at least one further gelling agent, such as pectin.

In some embodiments the amorphous solid may include gelling agent comprising carrageenan.

Suitably, the amorphous solid may comprise from about 5 wt %, 10 wt %, 15 wt %, or 20 wt % to about 80 wt %, 70 wt %, 60 wt %, 55 wt %, 50 wt %, 45 wt % 40 wt %, or 35 wt % of an aerosol generating agent (all calculated on a dry weight basis). The aerosol generating agent may act as a plasticizer. For example, the amorphous solid may comprise 5-60 wt %, 10-50 wt % or 20-40 wt % of an aerosol generating agent. In some cases, the aerosol generating agent comprises one or more compound selected from erythritol, propylene glycol, glycerol, triacetin, sorbitol and xylitol. In some cases, the aerosol generating agent comprises, consists essentially of or consists of glycerol. The inventors have established that if the content of the plasticizer is too high, the amorphous solid may absorb water resulting in a material that does not create an appropriate consumption experience in use. The inventors have established that if the plasticizer content is too low, the amorphous solid may be brittle and easily broken.

In some cases, the amorphous solid additionally comprises an active substance. For example, in some cases, the amorphous solid additionally comprises a tobacco material and/or nicotine. For example, the amorphous solid may additionally comprise powdered tobacco and/or nicotine and/or a tobacco extract. In some cases, the amorphous solid may comprise from about 1 wt %, 5 wt %, 10 wt %, 15 wt %, 20 wt % or 25 wt % to about 70 wt %, 50 wt %, 45 wt % or 40 wt % (calculated on a dry weight basis) of active substance. In some cases, the amorphous solid may comprise from about 1 wt %, 5 wt %, 10 wt %, 15 wt %, 20 wt % or 25 wt % to about 70 wt %, 60 wt %, 50 wt %, 45 wt % or 40 wt % (calculated on a dry weight basis) of a tobacco material and/or nicotine.

In some cases, the amorphous solid comprises an active substance such as tobacco extract. In some cases, the amorphous solid may comprise 5-60 wt % (calculated on a dry weight basis) of tobacco extract. In some cases, the amorphous solid may comprise from about 5 wt %, 10 wt %, 15 wt %, 20 wt % or 25 wt % to about 55 wt %, 50 wt %, 45 wt % or 40 wt % (calculated on a dry weight basis) tobacco extract. For example, the amorphous solid may comprise 5-60 wt %, 10-55 wt % or 25-55 wt % of tobacco extract. The tobacco extract may contain nicotine at a concentration such that the amorphous solid comprises 1 wt % 1.5 wt %, 2 wt % or 2.5 wt % to about 6 wt %, 5 wt %, 4.5 wt % or 4 wt % (calculated on a dry weight basis) of nicotine. In some cases, there may be no nicotine in the amorphous solid other than that which results from the tobacco extract.

In some embodiments the amorphous solid comprises no tobacco material but does comprise nicotine. In some such cases, the amorphous solid may comprise from about 1 wt %, 2 wt %, 3 wt % or 4 wt % to about 20 wt %, 15 wt %, 10 wt % or 5 wt % (calculated on a dry weight basis) of nicotine. For example, the amorphous solid may comprise 1-20 wt % or 2-5 wt % of nicotine.

The aerosol-generating material may comprise an acid. The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid.

In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid.

Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulfuric acid, hydrochloric acid, boric acid and phosphoric acid. In some embodiments, the acid is levulinic acid.

The inclusion of an acid is useful in embodiments in which the aerosol-generating material comprises nicotine. In such embodiments, the presence of an acid may stabilize dissolved species in the slurry from which the aerosol-generating material is formed. The presence of the acid may reduce or substantially prevent evaporation of nicotine during drying of the slurry, thereby reducing loss of nicotine during manufacturing.

In some cases, the amorphous solid may comprise a flavor. Suitably, the amorphous solid may comprise up to about 60 wt %, 50 wt %, 40 wt %, 30 wt %, 20 wt %, 10 wt % or 5 wt % of a flavor. In some cases, the amorphous solid may comprise at least about 0.5 wt %, 1 wt %, 2 wt %, 5 wt % 10 wt %, 20 wt % or 30 wt % of a flavor (all calculated on a dry weight basis). For example, the amorphous solid may comprise 0.1-60 wt %, 1-60 wt %, 5-60 wt %, 10-60 wt %, 20-50 wt % or 30-40 wt % of a flavor. In some cases, the flavor (if present) comprises, consists essentially of or consists of menthol. In some cases, the amorphous solid does not comprise a flavor.

In some cases, the total content of active substance and flavor may be at least about 0.1 wt %, 1 wt %, 5 wt %, 10 wt %, 20 wt %, 25 wt % or 30 wt %. In some cases, the total content of active substance and flavor may be less than about 80 wt %, 70 wt %, 60 wt %, 50 wt % or 40 wt % (all calculated on a dry weight basis).

In some embodiments, the amorphous solid is a hydrogel and comprises less than about 20 wt % of water calculated on a wet weight basis. In some cases, the hydrogel may comprise less than about 15 wt %, 12 wt % or 10 wt % of water calculated on a wet weight basis (WWB). In some cases, the hydrogel may comprise at least about 1 wt %, 2 wt % or at least about 5 wt % of water (WWB). The amorphous solid comprises from about 1 wt % to about 15 wt % water, or from about 5 wt % to about 15 wt % calculated on a wet weight basis. Suitably, the water content of the amorphous solid may be from about 5 wt %, 7 wt % or 9 wt % to about 15 wt %, 13 wt % or 11 wt % (WWB), most suitably about 10 wt %.

The amorphous solid may be made from a gel, and this gel may additionally comprise a solvent, included at 0.1-50 wt %. However, the inventors have established that the inclusion of a solvent in which the flavor is soluble may reduce the gel stability and the flavor may crystalize out of the gel. As such, in some cases, the gel does not include a solvent in which the flavor is soluble.

In some embodiments, the amorphous solid comprises less than 60 wt % of a filler, such as from 1 wt % to 60 wt %, or 5 wt % to 50 wt %, or 5 wt % to 30 wt %, or 10 wt % to 20 wt %.

In other embodiments, the amorphous solid comprises less than 20 wt %, suitably less than 10 wt % or less than 5 wt % of a filler. In some cases, the amorphous solid comprises less than 1 wt % of a filler, and in some cases, comprises no filler.

The filler, if present, may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives. In some cases, the amorphous solid comprises less than 1 wt % of a filler, and in some cases, comprises no filler. In particular, in some cases, the amorphous solid comprises no calcium carbonate such as chalk.

In some cases, the amorphous solid may consist essentially of, or consist of a gelling agent, an aerosol generating agent, an active substance (such as tobacco material and/or a nicotine source), water, and optionally a flavor and/or an active substance (such as tobacco material and/or a nicotine source).

Articles according to the present disclosure may be produced in any suitable format, for example as a rectangular closed chamber. Articles in this format may have any suitable dimensions, for example having a width in the range 10-40 mm, a length in the range 40-100 mm, and a depth in the range 2-10 mm.

The terms 'upstream' and 'downstream' used herein are relative terms defined in relation to the direction of mainstream aerosol drawn though an article or device in use.

The filamentary tow material described herein can comprise cellulose acetate fiber tow. The filamentary tow can also be formed using other materials used to form fibers, such as polyvinyl alcohol (PVOH), polylactic acid (PLA), polycaprolactone (PCL), poly(1-4 butanediol succinate) (PBS), poly(butylene adipate-co-terephthalate)(PBAT), starch based materials, cotton, aliphatic polyester materials and polysaccharide polymers or a combination thereof. The filamentary tow may be plasticized with a suitable plasticizer for the tow, such as triacetin where the material is cellulose acetate tow, or the tow may be non-plasticized. The tow can have any suitable specification, such as fibers having a 'Y' shaped or other cross section such as 'X' shaped, filamentary denier values between 2.5 and 15 denier per filament, for example between 8.0 and 11.0 denier per filament and total denier values of 5,000 to 50,000, for example between 10,000 and 40,000.

As used herein, the term "tobacco material" refers to any material comprising tobacco or derivatives or substitutes thereof. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, tobacco lamina, reconstituted tobacco and/or tobacco extract.

As used herein, the terms "flavor" and "flavorant" refer to materials which, where local regulations permit, may be used to create a desired taste or aroma in a product for adult consumers. One or more flavors can be used as the aerosol modifying agent described herein.

They may include extracts (e.g., licorice, *hydrangea*, Japanese white bark *magnolia* leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

According to the present disclosure, a "combustible" aerosol provision system is one where a constituent aerosolizable material of the aerosol provision system (or component thereof) is combusted or burned in order to facilitate delivery to a user.

According to the present disclosure, a "non-combustible" aerosol provision system is one where a constituent aerosolizable material of the aerosol provision system (or component thereof) is not combusted or burned in order to facilitate delivery to a user.

In the figures described herein, like reference numerals are used to illustrate equivalent features, articles or components.

According to the present disclosure, a 'component' for a non-combustible aerosol provision system can refer to a component of the non-combustible aerosol provision device, or to an article provided for use with the non-combustible aerosol provision device.

FIG. 1 is a perspective view of an article 10 for use with a non-combustible aerosol provision device. The article 10 comprises a consumable article for use with a non-combustible aerosol provision device, and is intended to be a replaceable component which, once depleted or spent, can be replaced with another article 10 for use with the non-combustible aerosol provision device. As referred to herein, a non-combustible aerosol provision system comprises a non-combustible aerosol provision device in combination with one or more articles 10, 10', 10" for use with the non-combustible aerosol provision device.

The article 10 comprises a chamber 4, which comprises an inlet aperture 3 and an outlet aperture 9 (not shown in FIG. 1). An air flow path is defined between the inlet aperture 3 and outlet aperture 9. The article 10 may comprise multiple inlet apertures 3.

In the present example, article 10 comprises 3 inlet apertures, formed in an end face 41 of the chamber. Outlet aperture 9 is formed on an opposing end face of the chamber 44 (outlet aperture 9 and end face 44 not shown in FIG. 1). In alternative embodiments the article can comprise a different number of inlet apertures, for example 1, 2, 3, 4 or 5 inlet apertures. In certain embodiments, in addition to inlet apertures 3 on end face 41, inlet apertures may also be provided on an adjacent face, such as adjacent face 42 and/or adjacent face 43, to introduce additional external air to the flow path. Without wishing to be bound by theory, it is hypothesized that providing additional inlet apertures on a face perpendicular to the air flow path can result in increased turbulence in the air flow through the article. Such increased turbulence can result in greater mixing of aerosol in the article, and result in an improved sensory experience when the aerosol is inhaled by the user.

In the present embodiment, inlet apertures 3 are of fixed size. However, in alternative embodiments the size of one or more inlet apertures may varied by a movable or otherwise adjustable element, provided to selectively close off one or more inlet apertures. In certain embodiments, the cross sectional area of the inlet and/or outlet aperture or apertures is less than the cross sectional area, measured perpendicular to the direction of flow, of the air flow path through the body. Providing an inlet and/or outlet aperture with a cross-sectional area that is less than that of the air flow path through the body provides a barrier to diffusion in and out of the body, and thereby restricts the mixing of the aerosol and ambient air. This arrangement can allow for improved control of the aerosol concentration delivered to the user.

The chamber 4 may have any suitable inner dimensions. For example, in various embodiments the chamber 4 may have a length (in the dimension along A-A') of between 40-120 mm, or between 50-90 mm, or between 60-80 mm. In the present example the chamber has a length of 75 mm. The chamber may have any suitable width (in the dimension along B-B'), such as 10-50 mm, or 15-25 mm. In the present example chamber 4 has a width of 20 mm. The chamber may also have any suitable height, for example in various embodiments in the range 2-10 mm, or 3-6 mm, or 3-5 mm. In the present case, the chamber has a height of 4 mm. The dimensions described herein refer to the inner dimensions of the chamber, so as to define the chamber volume, irrespective of the thickness of the material from which the chamber is formed.

In the present case, the chamber 4 is formed from cardboard. In alternative embodiments, chamber 4 may be formed from any suitable material, for example paper, foil, or plastic materials, or a laminate material comprising layers of any of the materials described herein. For example, the chamber may suitably be formed from a plastic material, such as polyether ether ketone (PEEK).

Figure 2:
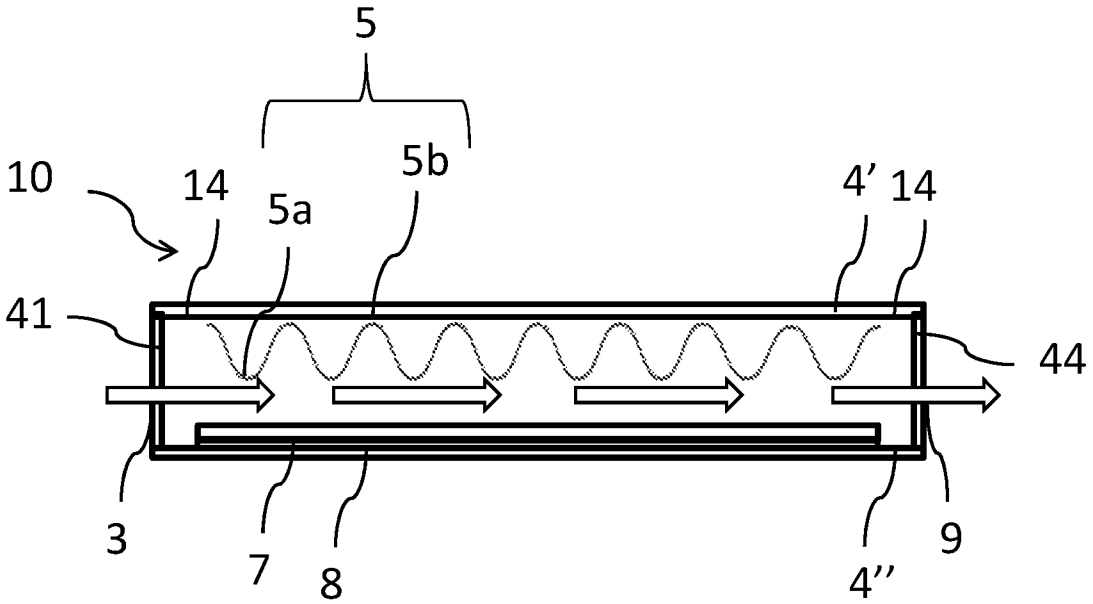
FIG. 2 is a side-on, cross sectional view of a component (e.g., an article) for use with a non-combustible aerosol provision device taken along the line A-A' of FIG. 1, the component comprising an article including a support element comprising an arrangement of ridges and grooves, and an aerosolizable material.

FIG. 2 is a side-on cross sectional view of the article 10 shown in FIG. 1, taken along the line A-A'. The air flow path between the inlet apertures 3 and the outlet aperture 9 is illustrated by the hollow arrows. In this embodiment, the air flow path is parallel to the upper face 4' of the chamber.

Chamber 4 contains a source of aerosolizable material, in the present example in the form of a layer of amorphous solid material 7. In alternative embodiments, the aerosolizable material may be provided in other forms, as described herein. In the present case amorphous solid material 7 is laminated on a carrier material 8, which in the present case is a sheet of aluminum foil. The layer of amorphous solid material 7 and carrier material 8 are arranged on a lower face 4" of the chamber 4. In alternative embodiments, the lower face 4" of the chamber may itself comprise the carrier material, and amorphous solid material 7 may be provided directly on the inner surface of the face 4". In the present example the layer of amorphous solid material 7 has a width of 7.4 mm, and a length of 65 mm, however in alternative embodiments the layer of amorphous solid sheet material may have any suitable dimensions for the size of the chamber 4 in which it is provided.

A sheet of corrugated material is mounted on an upper face 4' of the chamber 4, so as to form an arrangement of ridges 5*a* and grooves 5*b*. Ridge 5*a* and groove 5*b* together comprise corrugation 5. In the present case, the corrugations 5 are arranged such that the ridges 5*a* are uniformly spaced, and extend across the article, perpendicular to the direction of air flow. In alternative embodiments, the ridges and grooves may be configured to extend in other directions, such as parallel, or diagonal to the direction of air flow, and/or may be configured to have non-uniform spacing in any direction. Examples of such embodiments are set out in more detail herein. The term 'arrangement of ridges and grooves' as used herein refers to an arrangement comprising at least two ridges.

In the present case, the ridges 5*a* and grooves 5*b* are formed on a sheet of corrugated cardboard material which is mounted on the upper face 4' of the chamber, such that upper face 4' acts as a support for the corrugations. In this embodiment, the support is substantially planar, such that the ridges and the grooves each lie in substantially the same plane. In alternative embodiments, the ridges and corresponding grooves may be formed in other ways, such as by depositing material on the upper face 4', or by embossing. Alternatively, the sheet of corrugated material on which the ridges 5*a* and grooves 5*b* are formed may comprise a different material, such as paper, foil or plastic. In embodiments where the corrugations are formed on a metal material, such as aluminum foil, the corrugations may be heated by induction, when the article is used with a suitable device. This can be advantageous in reducing condensation of the aerosol on the surface of the corrugations.

Forming ridges and grooves on the upper surface 4' of the chamber reduces the volume of the chamber above the aerosolizable material. The inventors have found that reducing the chamber volume above the aerosolizable material results in improved aerosol delivery from the article, in use. Without wishing to be bound by theory, it is hypothesized that this results in increased velocity of the airflow through the chamber, and a reduction in the cooling and condensation of the aerosol within the article.

Where the ridges 5*a* and grooves 5*b* are formed as corrugations 5 on a sheet of corrugated material, ridge 5*a* and groove 5*b* may together also be referred to as a 'flute'. A sheet of corrugated material comprises a number of flutes, and the material may be defined in terms of the 'flute height and 'flute frequency'. Flute height is defined as the distance from the lowest point of a groove to the highest point of a corresponding ridge. The flute height is selected to provide a desirable separation between the ridges and the aerosolizable material, for example to reduce the height between the aerosolizable material and the ridges to less than 3 mm, or less than 2 mm, or less than 1.5 mm, for example 1 mm. In the present example, the flute height is between 2.5 mm and 3 mm, and the chamber height is 4 mm. The separation of the ridges formed by the flutes of the corrugations and the amorphous solid material 7 is therefore about 1 mm to 1.5 mm.

In alternative embodiments the flute height may be between 4.5 and 5 mm, or between 3.5 and 4 mm, or between 1.1 and 1.5 mm, or may be 0.75 mm, or 0.5 mm. The flute height may be an average value within the given ranges, or may be given as a target height with a manufacturing tolerance determining the range of flute heights on a sheet of corrugated material.

Flute frequency is a measure of the width of corrugations, and is defined as the number of flutes per meter (flutes/m). In the present example, the flute frequency is 154 flutes/m. However, in alternative examples the flute frequency can vary between 100 flutes/m and 600 flutes/m, or between 100 and 200 flutes/m, or between 200 and 200 flutes/m, or between 200 and 400 flutes per m, or between 100 and 180 flutes/m. The ranges for flute height and frequency defined herein are equally suitable for the height and spacing of an arrangement of ridges and grooves formed in any of the other ways described herein.

In the present example, corrugations 5 do not extend to the end faces of the chamber 41, 44, such that an area 14 which is free of corrugations is provided at each end of the chamber, adjacent to the inlet apertures 3 and the outlet aperture 9. The provision of an area free from corrugations at the inlet and outlet ends of the chamber results in a larger volume for aerosol mixing in these areas, which can result in the delivery of a more consistent aerosol, in use. The area 14 may have any suitable length, for example at least 1 mm, at least 2 mm, at least 3 mm, at least 4 mm or at least 5 mm. In the present example, the area 14 free of corrugations is 5 mm in length, and extends from both end faces 41, 44 of the chamber. In alternative embodiments the area 14 may be provided only at the downstream end of the chamber, adjacent to end face 44. Alternatively, the area 14 at the upstream end of the chamber may be a different length to the area 14 at the downstream end of the chamber. In further alternative embodiments, the corrugations may extend along the full length and/or width of the chamber Corrugations 5 may have any suitable profile, which are known to those skilled in the art.

In the present example, corrugations 5 comprise a sinusoidal, or repeated 'S' shaped corrugation profile, when viewed in cross section perpendicular to the direction in which the ridges of the corrugation extend. In alternative examples, a V shaped profile may be used, or a semi-circular profile.

Figure 3:
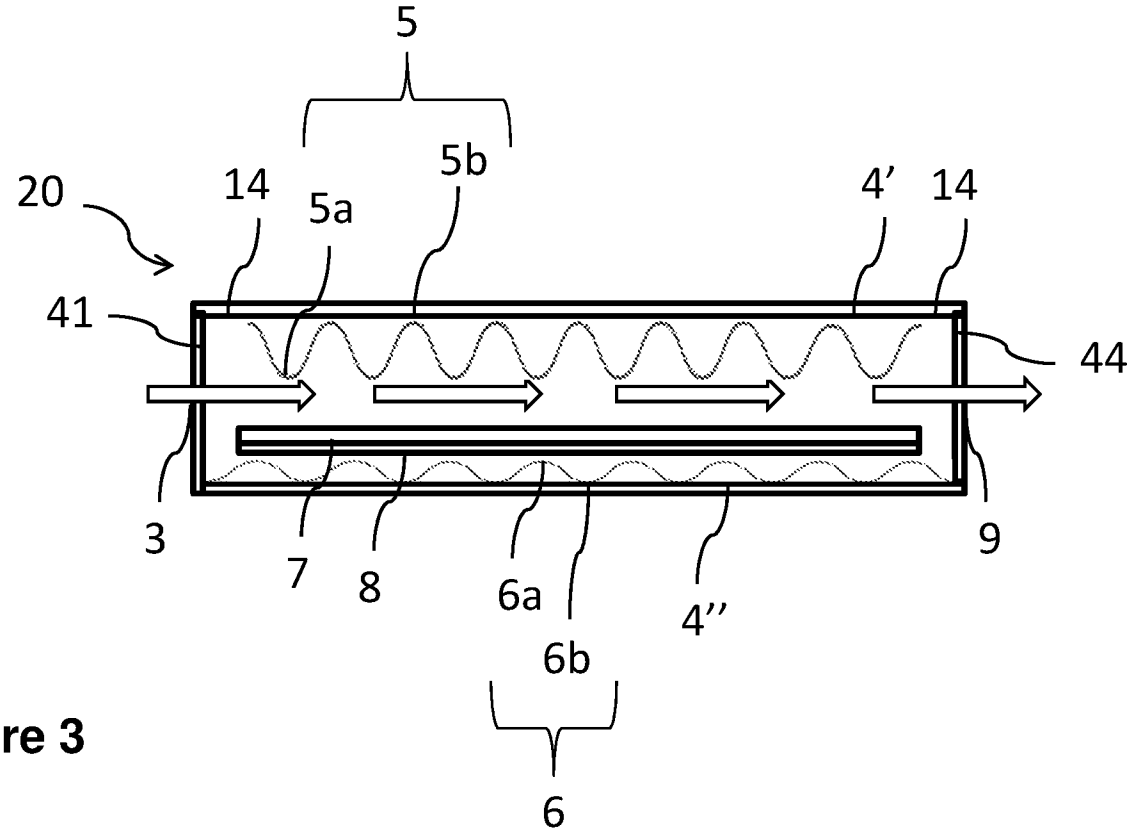
FIG. 3 is a side-on, cross sectional view of a further component (e.g., article) for use with a non-combustible aerosol provision device, in this example the component comprising an article comprising a first support element and a second support element.

FIG. 3 is a side-on, cross sectional view of a further article 20, taken along a line equivalent to the line A-A' of FIG. 1. Article 20 is the same as article 10, except that a second sheet of corrugated material, comprising ridges 6*a* and grooves 6*b* defining corrugations 6, is provided on the lower face 4" of the chamber, and the carrier material 8 and layer of amorphous solid material 7 are arranged on top of the corrugations 6.

In this example, the height of chamber 4 is 6 mm. The flute dimensions and profile of corrugations 5, and the separation between the ridges 5*a* and the amorphous solid material 7 is the same as described above in relation to the embodiment of FIG. 1. The additional chamber height is provided in order to accommodate second corrugations 6. However, in alternative embodiments the height of second corrugations 6 and corrugations 5 may be selected to fit within a 4 mm chamber height, and provide an approximately 1 mm separation between the amorphous solid material 7 and the ridges 5*a*. Second corrugations 6 provide additional structural support to the article 20.

Second corrugations 6 are formed on a sheet of corrugated material, as described for corrugations 5. The sheet of corrugated material on which corrugations 6 are formed extends from end face 41 of the chamber to end face 44, so as to provide structural support along the whole length of the chamber 4. In the present example corrugations 6 extend in the same direction as corrugations 5. However, in alternative examples the sheet of corrugated material may be arranged such that corrugations 6 extend perpendicularly to corrugations 5.

Figure 4A:
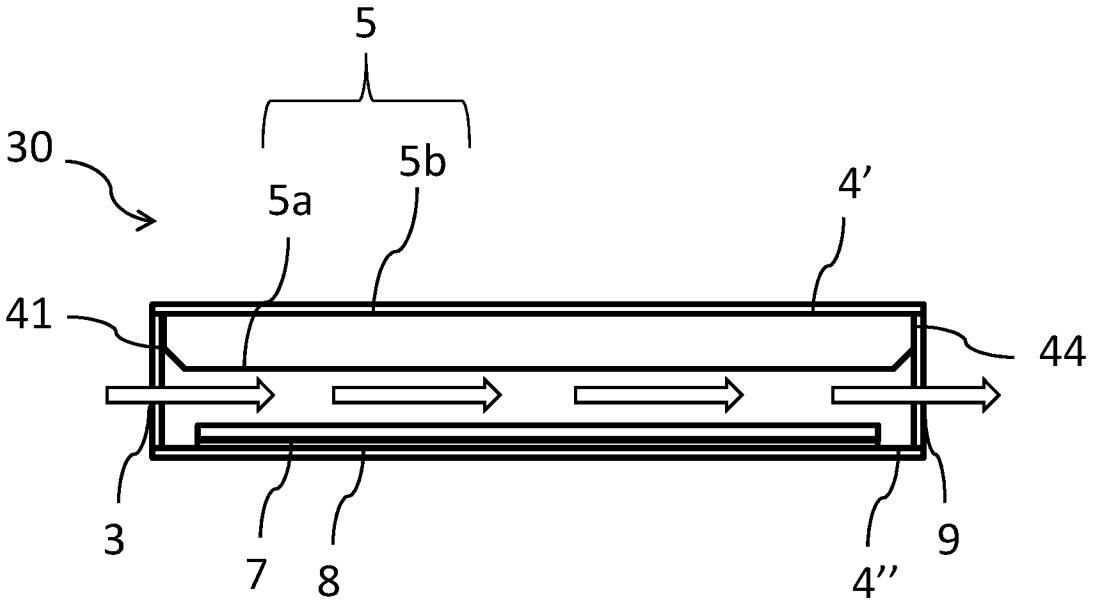
FIG. 4*a* is a side-on, cross sectional view of a further component (e.g., article) for use with a non-combustible aerosol provision device, in this example the component comprising an article comprising a support element comprising an arrangement of ridges and grooves.

FIG. 4*a* is a side-on cross sectional view of a further article 30 taken along a line equivalent to the line A-A' of FIG. 1. Article 30 is substantially the same as article 10, except that corrugations 5 are arranged to extend parallel to the direction of air flow, and extend along substantially the entire length of the chamber 4, from end face 41 to end face 44.

Where corrugations 5 extend parallel to the direction of air flow, the ridges 5*a* and grooves 5*b* effectively form channels which guide the aerosol toward the outlet aperture 9. A benefit of the aerosol being guided through the chamber by such corrugations may be to reduce the dwell time of the aerosol in the chamber.

In the present example, inlet apertures 3 are provided in a position on end face 41 such that air enters the chamber 4 below the level of the ridges 5*a*. For example, in the present example the flute height is between 2.5-3 mm, and inlet apertures 3 are provided in the 1 mm portion of the end face 41 which is below the level of the ridges 5*a*. Providing air inlet apertures 3 below the level of corrugations 5 can reduce the amount of air passing through the chamber 4 via the space between the corrugations 5 and the upper face 4'. The mixing of air which has passed above the corrugations with aerosol formed in the chamber can result in undesirable dilution and/or cooling of the aerosol delivered to the user through the outlet aperture 9.

Figure 4B:
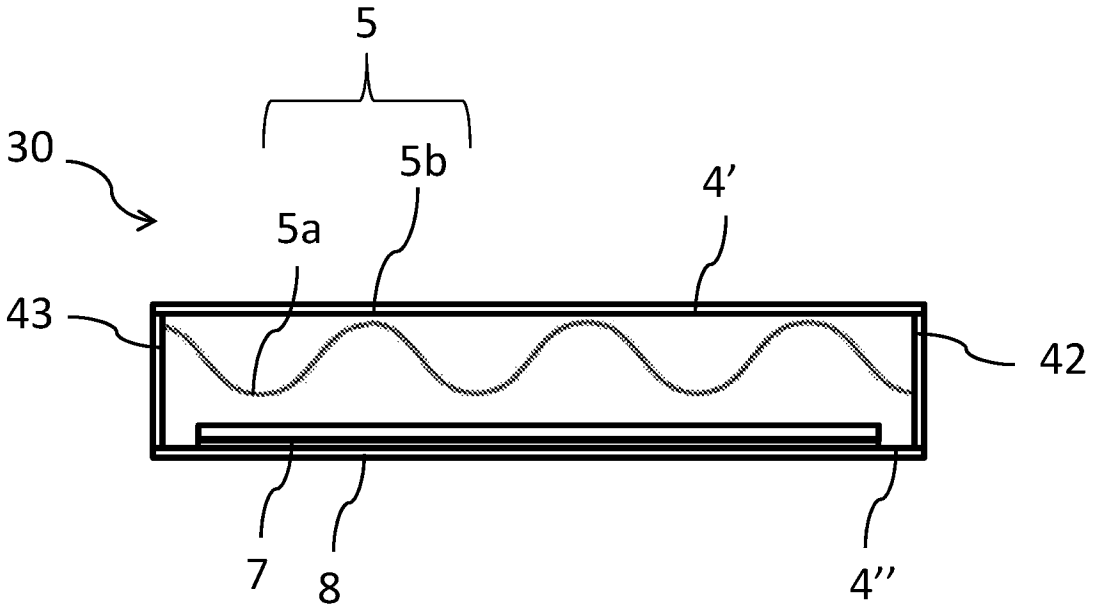
FIG. 4*b* is a side-on, cross sectional view of the component (e.g., article) of FIG. 4*a*, taken along an equivalent line to the B-B' line of FIG. 1.

FIG. 4*b* is a cross-sectional view of the article 30 illustrated in FIG. 4*a*, taken along a line equivalent to the B-B' line of FIG. 1. FIG. 4*b* illustrates the separation between the ridges 5*a* and the amorphous solid material 7, and the corrugation profile which effectively forms channels along which the air flow through the body 4 is directed. In the present embodiment the corrugations 5 have a flute height such that the separation between the ridges 5*a* and the amorphous solid material 7 is about 1-1.5 mm, however in alternative embodiments the ridges 5*a* and the amorphous solid material may be separated by a smaller distance, or in contact. Alternatively, ridges 5*a* may contact the carrier material 8 but not the amorphous solid material, in embodiments where the amorphous solid material is provided as a plurality of discrete elements, such as described in FIGS. 5*a* and 5*b*.

Figure 5A:
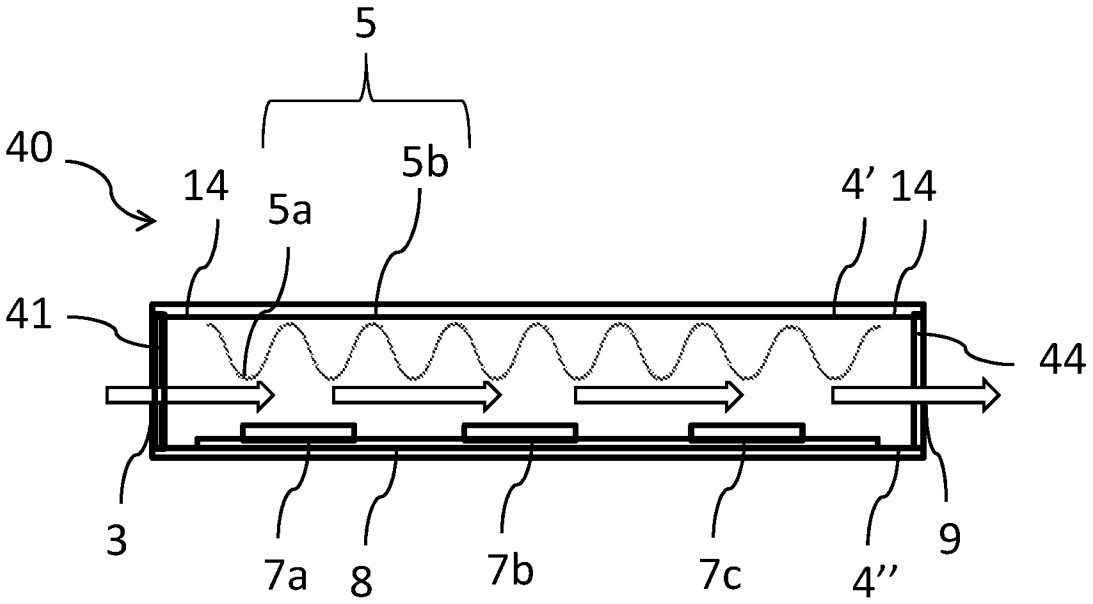
FIG. 5*a* is a side-on, cross sectional view of a further component (e.g., article) for use with a non-combustible aerosol provision device, in this example the component comprising an article comprising aerosolizable material provided as multiple discrete elements.

FIG. 5*a* is a side-on, cross sectional view of a further article 40 for use in a non-combustible aerosol provision system. Article 40 is substantially the same as article 10, except that amorphous solid material 7 is provided as a plurality of discrete elements 7*a*, 7*b*, 7*c*, etc., laminated on carrier material 8. Each discrete element 7*a*, 7*b*, 7*c* etc. may comprise the same amorphous solid material, or each element may comprise amorphous solid material of a different composition. In the present example each discrete element comprises the same composition of amorphous solid material.

In the present example, article 40 is provided with an array of six discrete elements of amorphous solid material, which are substantially rectangular in shape. However, in alternative embodiments the article 40 may be provided with any number of discrete elements of amorphous solid material, for example 2, 3, 4, 5, 6, 7 or 8 discrete elements, which may be of any suitable shape and dimensions, as would be clear to one skilled in the art.

Figure 5B:
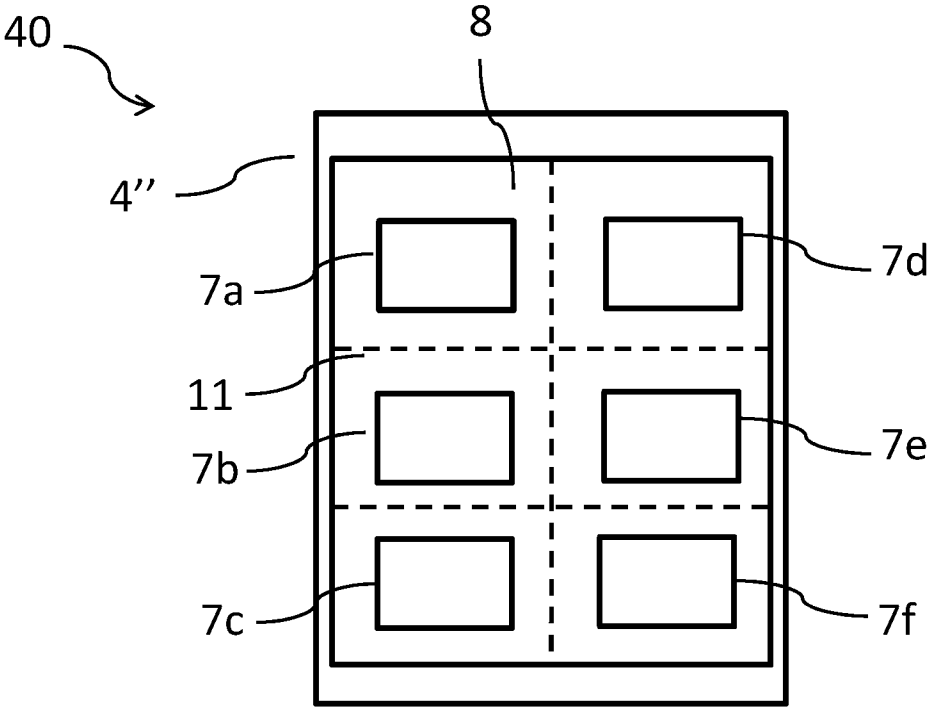
FIG. 5*b* is a top-down, cross sectional view of the component (e.g., article) for use with a non-combustible aerosol provision device shown in FIG. 6, taken on an equivalent plane to the AB plane of FIG. 1.

FIG. 5*b* is a top-down, cross sectional view of the article 40 shown in FIG. 5*a*, taken in a direction equivalent to the AB plane of FIG. 1. In this example, carrier material 8 comprises perforations 11 between the discrete elements of amorphous solid material. Particularly in embodiments where carrier material 8 comprises a metal foil, perforations 11 can inhibit the conduction of heat across the carrier material. Providing perforations 11 can be advantageous in embodiments where it is desirable to separately heat each discrete element, since the perforations provide a barrier to heat transfer between the discrete elements.

Figure 6:
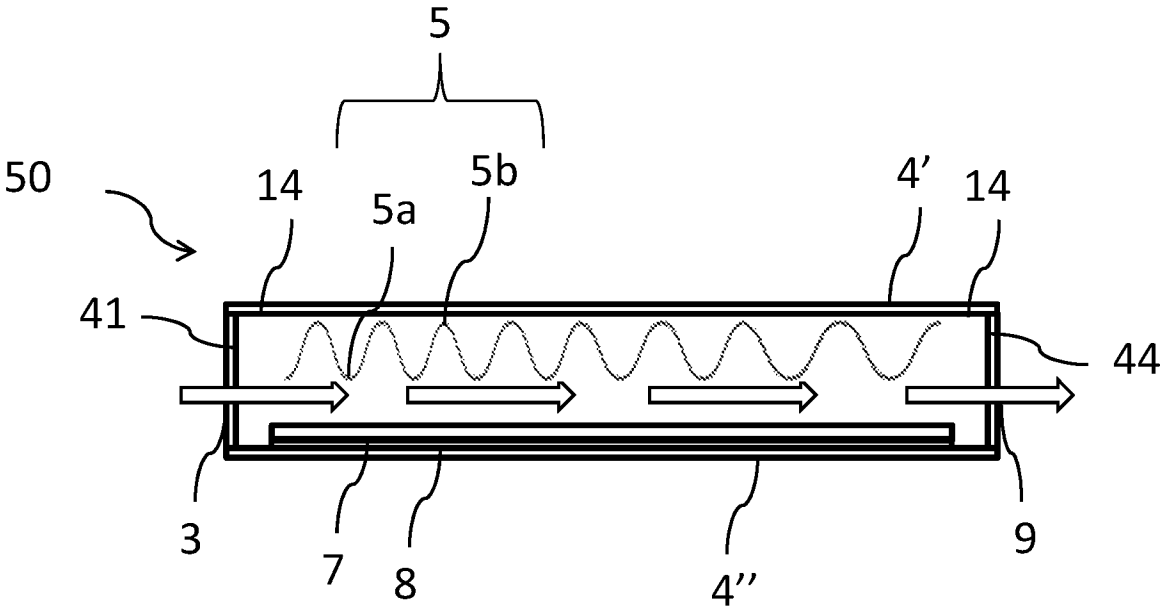
FIG. 6 is a side-on, cross sectional view of a further component (e.g., article) for use with a non-combustible aerosol provision device, in this example the component comprising an article comprising a non-uniform arrangement of ridges and grooves.

FIG. 6 is a side-on, cross sectional view of a further article 50 for use in a non-combustible aerosol provision system. Article 50 is substantially the same as article 10, except that corrugations 5 are provided with non-uniform spacing between ridges 5*a*. In this example, the spacing between the ridges increases in the direction parallel to the direction of air flow, such that the spacing between ridges 5*a* at the downstream end of the chamber 4 is greater than the spacing between ridges 5*a* at the upstream end of the chamber 4. However, in an alternative embodiment, the spacing between the ridges decreases in the direction parallel to the direction of air flow, such that the spacing between ridges 5*a* at the downstream end of the chamber 4 is less than the spacing between ridges 5*a* at the upstream end of the chamber 4.

Figure 7:
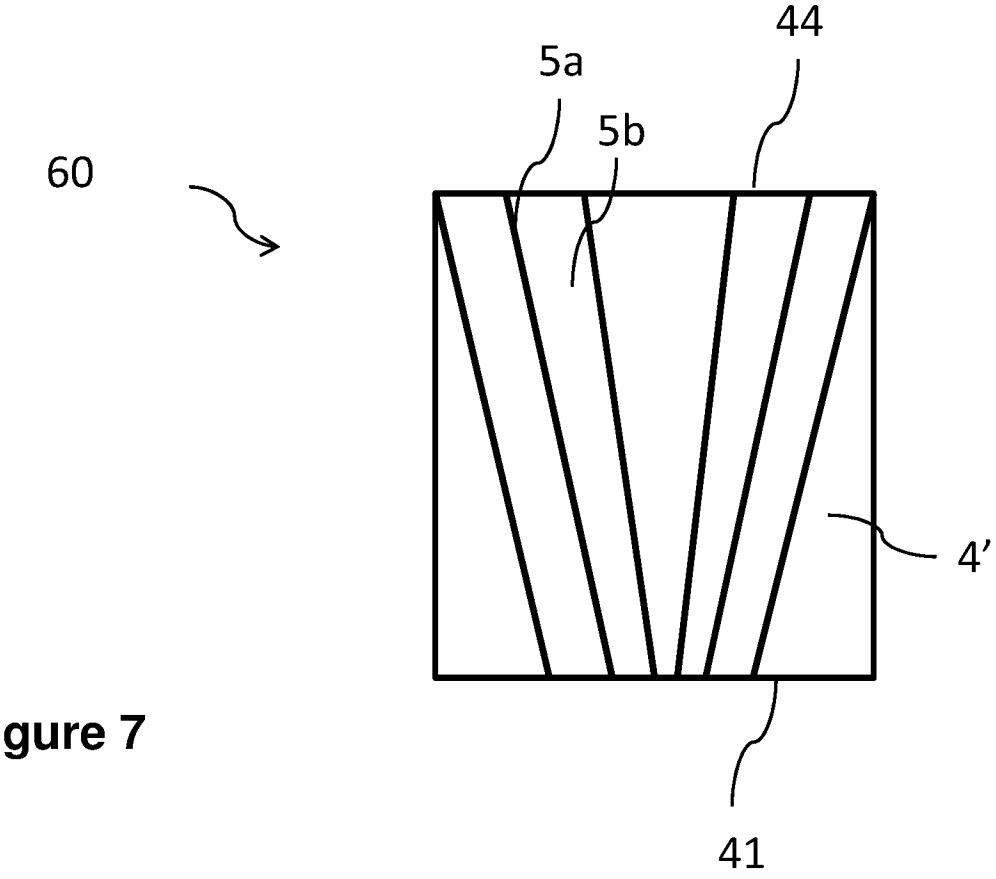
FIG. 7 is a bottom-up, cross sectional view of a further component (e.g., article) for use with a non-combustible aerosol provision device taken on an equivalent plane to the AB plane of FIG. 1, in this example the support element comprising diverging ridges and grooves.

FIG. 7 is a bottom-up, cross sectional view of a further article 60 for use in a non-combustible aerosol provision system, taken in a direction equivalent to the AB plane of FIG. 1. Article 60 is substantially the same as article 30, except that in this example, the ridges 5*a* are arranged to extend divergently along the direction of the air flow path, such that the spacing between adjacent ridges at the downstream end of the chamber 4 is greater than the spacing between adjacent ridges at the upstream end of the chamber 4. Without wishing to be bound by theory, it is hypothesized that the smaller volume of the channel defined by adjacent corrugations at the upstream end of the chamber 4 will result in a greater air flow velocity through the upstream end of the chamber compared to flow through the downstream end of the chamber, such that the dwell time in the chamber of aerosol generated at the upstream end or the downstream end is substantially the same, resulting in delivery of a more consistent aerosol.

Figure 8:
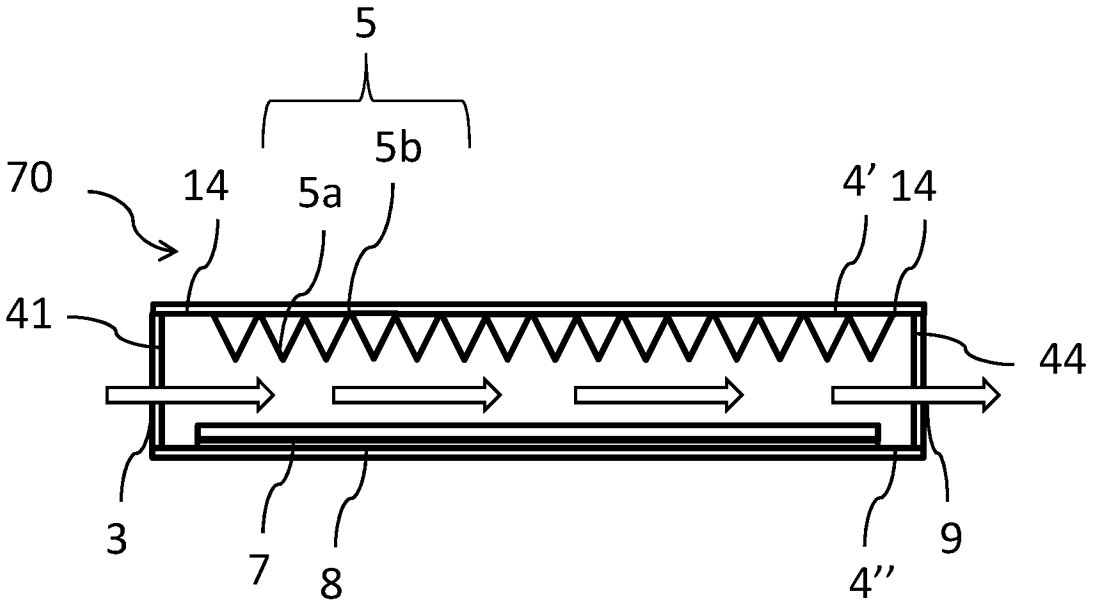
FIG. 8 is a cross sectional view of a further component (e.g., article) for a non-combustible aerosol provision system, comprising an alternative arrangement of ridges and grooves.
Figure 9:
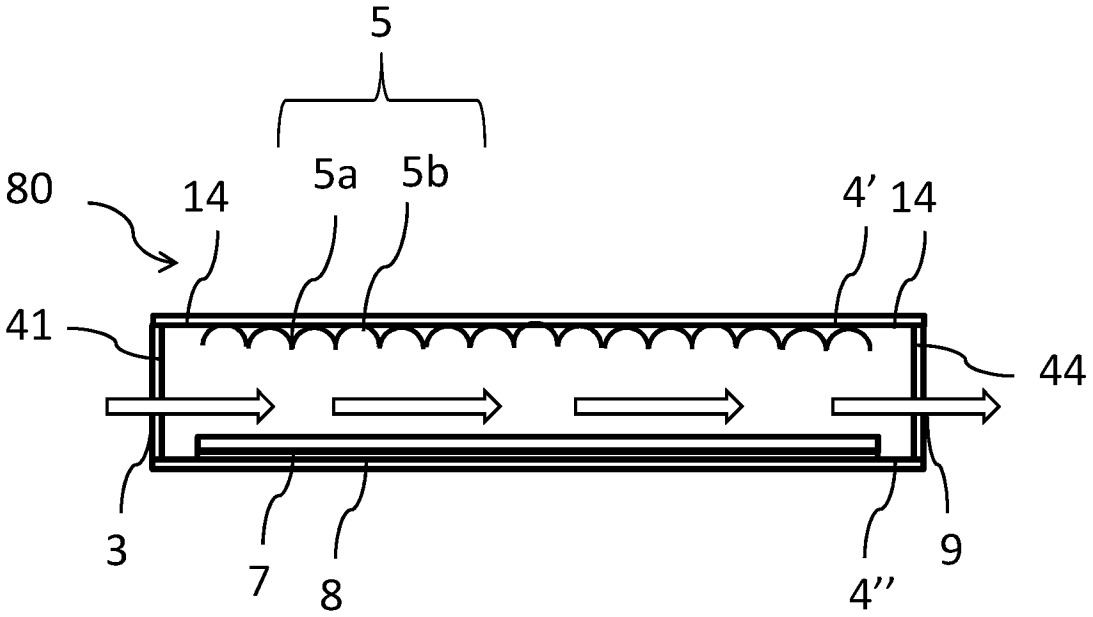
FIG. 9 is a cross sectional view of a further component (e.g., article) for a non-combustible aerosol provision system, comprising an alternative arrangement of ridges and grooves.

FIGS. 8 and 9 are side-on, cross sectional views of further articles 70, 80 for use in a non-combustible aerosol provision system. Articles 70 and 80 are substantially the same as article 10, except each article comprises an alternative corrugation profile.

Article 70 comprises corrugations having a V shaped profile, and article 80 comprises corrugations having a semi-circular profile.

Figure 10:
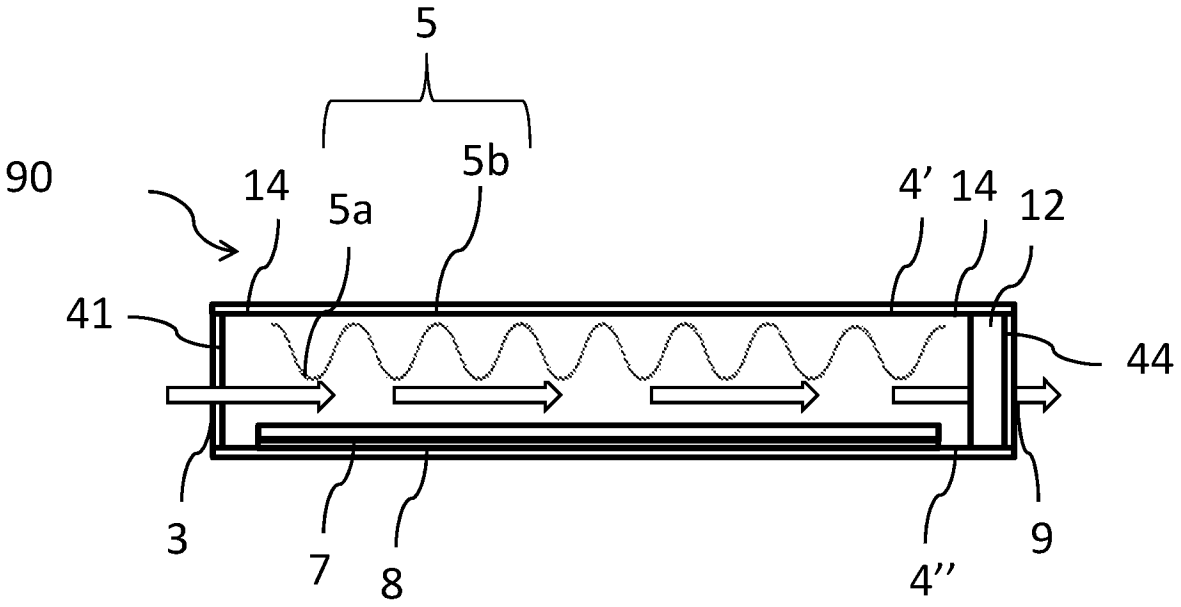
FIG. 10 is a is a side-on, cross sectional view of a further component (e.g., article) for use with a non-combustible aerosol provision device, in this example the component comprising an article comprising a body of fibrous material.

FIG. 10 is a side-on, cross sectional view of a further article 90 for use in a non-combustible aerosol provision system. Article 90 is the same as article 10, except that chamber 4 also includes a body of material 12. In the present example, body of material 12 is provided as a plug of fibrous material at a downstream end of the chamber 4, adjacent to and abutting the end face 44 comprising outlet aperture 9. In the present example, body of material 12 is formed from a plug of cellulose acetate tow, however in alternative embodiments body of material 12 may be formed from alternative materials, such as a foam or sponge material, or any Other suitable material as would be known to those skilled in the art. In alternative embodiments the body of material 12 may be provided as a layer arranged above the amorphous solid material, or arranged between the lower face 4" and the carrier material 8.

The articles 10, 20, 30, 40, 50, 60, 70, 80, 90, described herein may comprise any feature or combination of features from any of the other embodiments described herein.

In examples, the amorphous solid material 7 has a thickness of 0.07 mm. In alternative embodiments the amorphous solid sheet material may have any suitable thickness as described herein. Suitably, in any of these embodiments, the amorphous solid has a thickness of from about 50 μm to about 200 μm, or about 50 μm to about 100 μm, or about 60 μm to about 90 μm, suitably about 77 μm.

In embodiments in which the carrier material comprises aluminum foil, the aluminum foil may comprise a layer having a thickness of about 6 μm. However, in alternative arrangements, the aluminum foil can be other thicknesses, for instance between 4 μm and 16 μm in thickness.

In alternative embodiments, the non-combustible aerosol provision device can comprise a chamber 401. Chamber 401 may be an assembly of the non-combustible aerosol provision system.

The chamber 401 in the device can comprise the features of chamber 4 as described herein with reference to article 10, except that chamber 401 does not comprise an aerosol-generating material. Chamber 401 is configured to receive an article 10' which comprises aerosol-generating material. Chamber 401 provides the advantages associated with chamber 4, for instance in providing a defined volume through which air flow can be channeled, and that the arrangement of ridges and grooves can increase desirable turbulence in the air flow through the chamber 401, whilst also providing further advantages in manufacturing, for instance. For example, where the non-combustible aerosol provision device comprises chamber 401, the advantages associated with the body comprising an arrangement of ridges and grooves, as described herein, can be achieved with reduced manufacturing cost compared to where an article 10 comprises the body having an arrangement of ridges and grooves, since the arrangement of ridges and grooves do not need to be manufactured multiple times and replaced with each consumable article.

In embodiments where the non-combustible aerosol provision device comprises chamber 401, article 10 is not intended to be used with the non-combustible aerosol provision device to provide a non-combustible aerosol provision system. In such embodiments, chamber 401 is configured to receive article 10'. Article 10' can comprise many features in common with carrier material 8, and the amorphous solid material provided thereon, as described herein with reference to the aerosol-generating material provided in chamber 4, but differs in that article 10' does not define an enclosed volume. Article 10' instead provides aerosol-generating material on a surface in an 'open consumable' arrangement, so that when article 10' is inserted in chamber 401, the aerosol-generating material is in fluid communication with the air inside the volume defined by chamber 401.

Figure 11:
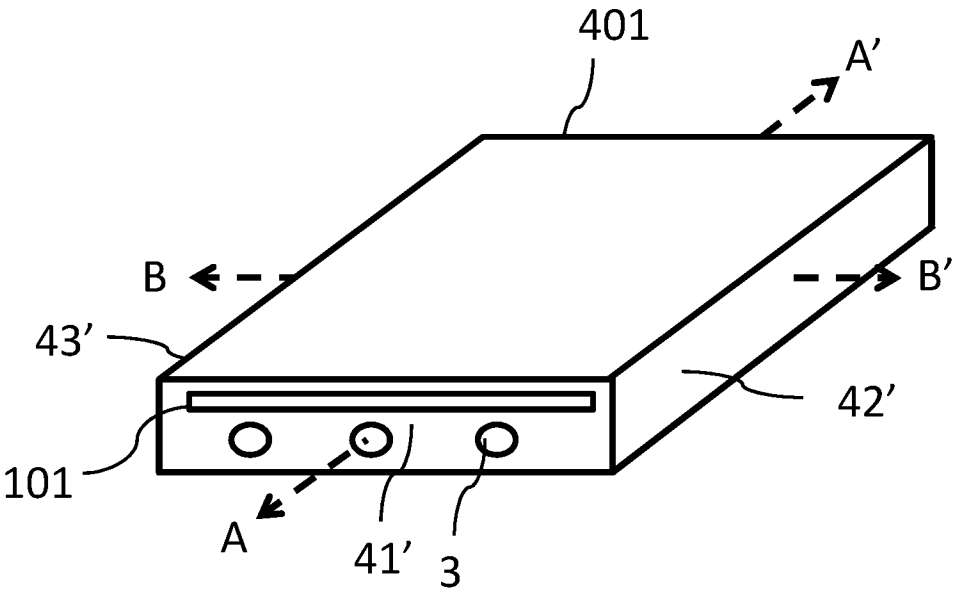
FIG. 11 is a perspective illustration of component for a non-combustible aerosol provision device, comprising a chamber comprising an arrangement of ridges and grooves.

FIG. 11 is a perspective illustration of a chamber 401 suitable for use as a component of a non-combustible aerosol provision device. Chamber 401 is substantially the same as chamber 4 described herein, except that chamber 401 does not contain an aerosol-generating material and is intended for use with a separate consumable article 10' which comprises an aerosol-generating material. The features of chamber 4 described above which relate to the aerosol generating material do not apply to chamber 401.

Chamber 401 comprises an insertion aperture 101 through which article 10' can be inserted.

In the present example, aperture 101 is on the end face 41' of the chamber 401. In other examples, the insertion aperture 101 may be on any of the faces of the chamber, for example adjacent faces 42', 43', or an opposite end face of the chamber (not shown). Insertion aperture 101 may take any suitable shape. Insertion aperture 101 may extend only partially along the length of a face, or may extend across the entire length of a face. Insertion aperture 101 has a height, which may be for example, half the height of the face on which the insertion aperture is provided, less than half the height of the face on which the insertion aperture is provided, for instance about one third of the height of the face on which the insertion aperture is provided. In the present example, insertion aperture 101 provided on face 41' has a length of about 85% of the length of the face 41', and a height of about one quarter of the height of the face 41'.

In some examples, the inlet aperture 101 may be sealable, for example by use of a removable cap configured for insertion in the aperture 101. Alternatively, an end portion of the article can be configured to block the aperture 101 so as to prevent or restrict the ingress of external air into the chamber through aperture 101, when the article is inserted. For example, the article may comprise an end section which is configured to be thicker than the height of the aperture 101, so that, in use, the thicker end section of the article prevents the article from being wholly inserted into the chamber, and provides a barrier to the ingress of external air by abutting the end surface of chamber 401 above or below the aperture 101. Such an arrangement may also make it easier for the user to grasp the end section of article for removal.

In alternative embodiments (not shown), chamber 401 may not comprise an insertion aperture 101. As an alternative, chamber 401 may be formed in separable parts, for instance two parts, at least one of which may be removable by the user to facilitate insertion of the article 10'. For example, a first section of the chamber may comprise the arrangement of ridges and grooves, and a second section of the chamber may comprise a covering section configured to be removably affixed to the first section so as to form chamber 401. In some embodiments, separable parts of chamber 401 may be hingedly connected, to enable the user to open the chamber.

Chamber 401 may be formed from any suitable material. For example, chamber 401 may be formed from a plastic material, such as polyether ether ketone (PEEK).

The non-combustible aerosol provision device may comprise a heater, and chamber 401 may be configured so that article 10', 10" is held in close proximity or contact with the heater.

Figure 12:
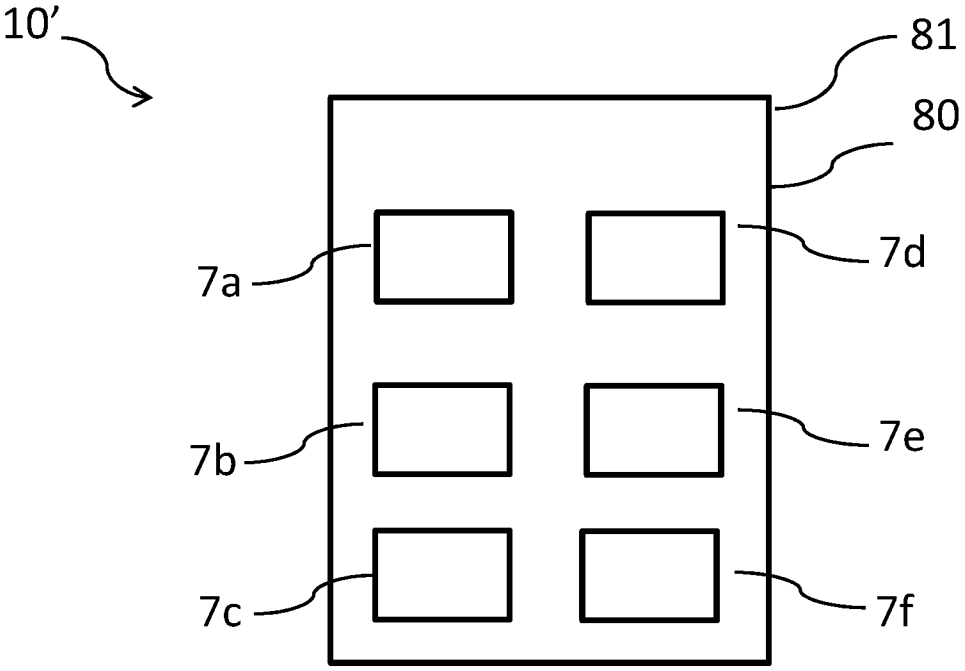
FIG. 12 is a top-down, cross-sectional view of article 10', for insertion in the device chamber 401 shown in FIG. 11.

FIG. 12 is a top-down, cross-sectional view of article 10', for insertion in the device chamber 401 shown in FIG. 11. Article 10' comprises a carrier support 80. Carrier support 80 is selected to provide structural support to the article 10' so that the article 10' can be easily handled by the user and inserted into chamber 401. Suitable materials for the carrier support 80 include stiff paper, card, and plastic. In some embodiments, carrier support 80 may be provided as a laminate material. For instance, carrier support 80 may comprise a foil layer laminated on card.

The article 10' comprises a plurality of discrete elements of amorphous solid material 7*a*, 7*b*, 7*c*, etc., as described with reference to FIG. 5*b*. Article 10' may comprise an extended end section 81 at one or more edges of the article 10'. End section 81 does not comprise aerosol-generating material. The article 10' may be configured such that end section 81 extends outside the insertion aperture 101 of chamber 401 when the consumable is fully inserted in the chamber, so that the user can easily grasp and remove the article 10'.

Figure 13:
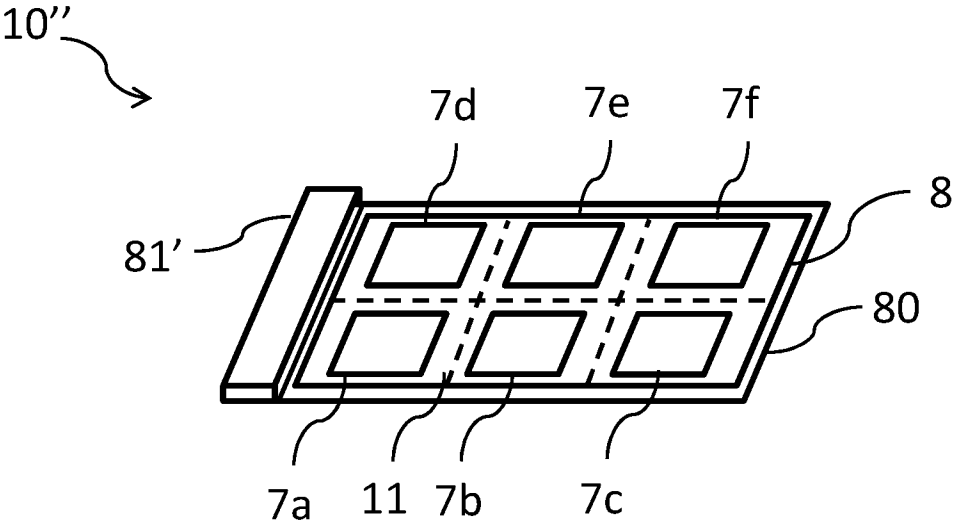
FIG. 13 is a perspective illustration of a further article 10" for insertion in the device chamber 401 shown in FIG. 11.

FIG. 13 is a perspective illustration of a further article 10" for insertion in the device chamber 401 shown in FIG. 11. Article 10" further comprises a carrier material 8, as described in relation to FIG. 5*b*. In the present example, carrier material 8 is laminated on the carrier support 80. In the present example, carrier material 8 does not extend to the edges of the consumable. In other embodiments, carrier material 8 may extend across the full area of the carrier support 80. In the present example, carrier material 8 comprises perforations 11, as described in relation to FIG. 5*b*. Carrier material 8 may be formed from any suitable material. Suitable materials for carrier material 8 are materials which are suitable for heating by induction.

Article 10" comprises thicker end section 81', which is configured to have a thickness greater than the height of the insertion aperture 101 of the chamber 401. Thicker end section 81 may be formed in any suitable way, such as from a section of thicker paper or card adhered to end portion of the article. Thicker end section can provide the benefit described in relation to FIG. 11 of providing a barrier to the ingress of air through the inlet aperture 101 when the article 10" is inserted in the chamber 401.

The various embodiments described herein are presented only to assist in understanding and teaching the disclosed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the disclosure, and that other embodiments may be utilized and modifications may be made without departing from the scope of the disclosure. Various embodiments of the disclosure may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A component for a non-combustible aerosol provision system, the component comprising:

a body defining an enclosed volume, the body comprising an inlet aperture and an outlet aperture, and an air flow path defined between the inlet aperture and the outlet aperture through the enclosed volume;

wherein the body includes a support element comprising an arrangement of alternating ridges and grooves, and wherein the support element is a panel and the arrangement of alternating ridges and grooves are formed on a corrugated sheet mounted on the panel.

2. The component of claim 1, wherein the body is configured to receive an aerosol generating material.

3. The component of claim 1, wherein the component is an article, and an aerosol generating material is provided within the enclosed volume.

4. The component of claim 3, wherein the aerosol-generating material is provided spaced apart from the support element.

5. The component of claim 3, wherein the aerosol-generating material comprises an amorphous solid.

6. The component of claim 5, wherein the amorphous solid is laminated on a carrier element.

7. The component of claim 5, wherein the amorphous solid is provided as a single sheet of amorphous solid material.

8. The component of claim 5, wherein the amorphous solid is provided as multiple discrete elements of amorphous solid material.

9. A system comprising a component according to claim 3, and a non-combustible aerosol provision device for heating the aerosol-generating material of the component.

10. The component of claim 1, wherein the body comprises a chamber and a face of the chamber comprises the support element.

11. The component of claim 1, wherein the ridges and grooves are arranged to extend substantially parallel to the direction of air flow through the article, in use.

12. The component of claim 1, wherein the ridges and grooves are arranged to extend substantially perpendicular to the direction of air flow through the article, in use.

13. The component of claim 1, wherein the spacing between adjacent ridges and grooves is non-uniform in the direction in which the ridges and grooves extend.

14. The component of claim 1, wherein the spacing between adjacent ridges and grooves is non-uniform in the direction perpendicular to the direction in which the ridges and grooves extend.

15. The component of claim 1, wherein the ridges and grooves do not extend across the whole length of the support element.

16. The component of claim 1, wherein a body of gas permeable material is provided in the closed volume.

17. The component of claim 16, wherein the component is an article, and an aerosol generating material is provided within the enclosed volume, and wherein the body of gas permeable material is arranged adjacent to the aerosol-generating material.

18. The component of claim 16, wherein the component is an article, and an aerosol generating material is provided within the enclosed volume, and wherein the body of gas permeable material is arranged downstream of the aerosol-generating material.

19. A system comprising a non-combustible aerosol provision device comprising a component according to claim 1, and an article comprising an aerosol-generating material.

* * * * *